US012110467B2

(12) United States Patent
Suzuki

(10) Patent No.: US 12,110,467 B2
(45) Date of Patent: Oct. 8, 2024

(54) LUBRICATING OIL COMPOSITION

(71) Applicant: SHELL OIL COMPANY, Houston, TX (US)

(72) Inventor: Kengo Suzuki, Kanagawa (JP)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/041,132

(22) PCT Filed: Sep. 6, 2021

(86) PCT No.: PCT/EP2021/074452

§ 371 (c)(1),
(2) Date: Feb. 9, 2023

(87) PCT Pub. No.: WO2022/053424

PCT Pub. Date: Mar. 17, 2022

(65) Prior Publication Data

US 2023/0257671 A1 Aug. 17, 2023

(30) Foreign Application Priority Data

Sep. 8, 2020 (JP) ..... 2020-150804

(51) Int. Cl.

| | |
|---|---|
| ***C10M 125/10*** | (2006.01) |
| ***C10M 125/24*** | (2006.01) |
| ***C10M 169/04*** | (2006.01) |
| ***C10N 20/00*** | (2006.01) |
| ***C10N 20/06*** | (2006.01) |
| ***C10N 30/06*** | (2006.01) |

(52) U.S. Cl.

CPC ..... *C10M 125/10* (2013.01); *C10M 125/24* (2013.01); *C10M 169/04* (2013.01); *C10M 2201/062* (2013.01); *C10M 2201/085* (2013.01); *C10M 2203/003* (2013.01); *C10M 2223/06* (2013.01); *C10N 2020/06* (2013.01); *C10N 2020/061* (2020.05); *C10N 2030/06* (2013.01)

(58) Field of Classification Search

CPC ..... C10M 125/04; C10M 125/10; C10M 169/04; C10M 2201/062; C10M 2201/085; C10M 2203/003; C10N 2020/06; C10N 2020/061; C10N 2030/06

See application file for complete search history.

(56) References Cited

U.S. PATENT DOCUMENTS

| | | | | |
|---|---|---|---|---|
| 8,598,098 | B2 | 12/2013 | Nakagawa et al. | |
| 2018/0029119 | A1* | 2/2018 | Curreli | B22F 3/17 |
| 2018/0291305 | A1* | 10/2018 | Kumar Tompala | C10M 101/02 |

FOREIGN PATENT DOCUMENTS

| | | | | |
|---|---|---|---|---|
| CN | 101875875 | A | 11/2010 | |
| CN | 108085089 | A * | 5/2018 | C10M 125/26 |
| JP | 2010024318 | A | 2/2010 | |
| JP | 2020180248 | A | 11/2020 | |
| JP | 2020180249 | A | 11/2020 | |
| WO | WO-2010077773 | A1 * | 7/2010 | C10M 105/76 |

OTHER PUBLICATIONS

Hotchkiss, P.J., "The Design, Synthesis, and Use of Phosphonic Acids for the Surface Modification of Metal Oxides", Georgia Institute of Technology, 2008. (Year: 2008).*

English-language machine translation of CN 108085089 A (Year: 2018).*

International Search Report and Written Opinion Received for PCT Patent Application No. PCT/EP2021/074452, Mailed on Dec. 8, 2021, 10 Pages.

Hotchkiss, "The Design, Synthesis, and Use of Phosphonic Acids for the Surface Modification of Metal Oxides", Georgia Institute of Technology, Retrieved from the Internet URL :<https://smartech.gatech.edu/handle/1853/31836?show=full>, Dec. 2008, 453 Pages, XP055662718.

Alberti et al., "Layered and Pillared Metal(Iv) Phosphates and Phosphonates", Advanced Materials, 1996, vol. 3, Issue No. 4, pp. 291-303.

Office Action Received for Japanese Application No. 2020-150804, Mailed on Jun. 11, 2024, 10 Pages(5 Pages of English Translation and 5 Pages of Official Copy).

* cited by examiner

*Primary Examiner* — James C Goloboy
(74) *Attorney, Agent, or Firm* — SHELL USA, INC.

(57) ABSTRACT

The invention provides a lubricating oil composition comprising: a base oil; and coated particles made of nanoparticles and phosphonic acid coating at least a portion of the surface of the nanoparticles.

1 Claim, No Drawings

LUBRICATING OIL COMPOSITION

CROSS REFERENCE TO RELATED APPLICATIONS

This is a National stage application of International Application No. PCT/EP2021/074452, filed 6 Sep. 2021, which claims priority of Japan National Patent Application No. 2020-150804, filed 8 Sep. 2020 which is incorporated herein by reference in its entirety.

FIELD OF THE INVENTION

The present invention relates to a lubricating oil composition.

BACKGROUND OF THE INVENTION

In order to improve the fuel efficiency of automotive components, energy loss due to friction has to be prevented in an engine when driving a car. In other words, use of the lubricating oil composition to reduce the friction coefficient of sliding components is effective at improving fuel efficiency.

JP2008179738 discloses such a lubricating oil composition which contains a base oil, an oxygen-containing organic compound, diamond nanoparticles, and a dispersant for the diamond nanoparticles.

The lubricating oil composition in JP2008179738 can significantly reduce the friction coefficient, but even higher lubricity is required to meet the increasing demand for energy conservation.

In order to address this problem, an object of the present invention is to provide a lubricating oil composition having excellent lubricity.

SUMMARY OF THE INVENTION

The present inventor discovered that extremely high lubricity could be obtained by blending specific particles into a lubricating oil composition, and the present invention is a product of this discovery.

The present invention is a lubricating oil composition comprising: a base oil; and coated particles made of nanoparticles and phosphonic acid coating at least a portion of the surface of the nanoparticles. The nanoparticles may be a metal oxide. The surface coverage of the coated particles by the phosphonic acid may be 10% or more.

The present invention is also particles added to a lubricating oil composition, comprising a base oil, wherein the particles are coated particles containing nanoparticles and phosphonic acid coating the surface of the nanoparticles.

DETAILED DESCRIPTION OF THE INVENTION

The present invention is able to provide a lubricating oil composition having excellent lubricity.

Compositions, physical characteristics/properties, production methods, and applications for the lubricating oil composition are described below, but the present invention is not limited to these.

The lubricating oil composition contains a base oil and coated particles. The lubricating oil composition may also contain other components.

There are no particular restrictions on the base oil, which can be changed based on such factors as the application of the lubricating oil composition. Examples of base oils that can be used include mineral oils, synthetic oils, animal and plant oils, and mixtures of these commonly used in lubricating oil compositions. Specific examples include the base oil belonging to Group 1, Group 2, Group 3, and Group 4 of the API (American Petroleum Institute) base oil categories. One or more types of base oil can be used.

Group 1 base oils include paraffinic mineral oils obtained by an appropriate combination of refining methods such as solvent refining, hydrorefining, and dewaxing performed on lubricating oil fractions obtained from atmospheric distillation of crude oil. Group 2 base oils include paraffinic mineral oils obtained by an appropriate combination of refining methods such as hydrorefining and dewaxing performed on lubricating oil fractions obtained from atmospheric distillation of crude oil. Group 2 base oils refined using, for example, the Gulf Oil hydrorefining method have a total sulfur content of less than 10 ppm and an aromatic content of 5% or less. Use of these base oils is preferred in the present invention. Group 3 base oils and Group 2 class base oils include paraffinic mineral oils produced by a high degree of hydrorefining performed on lubricating oil fractions obtained from the atmospheric distillation of crude oil, base oils refined using the Isodewax process which dewaxes and substitutes the wax produced by the dewaxing process with isoparaffins, and base oils refined using the Mobil Oil wax isomerization process. Use of these base oils is also preferred in the present invention.

Examples of synthetic oils include polyolefins, dibasic acid diesters, trimellitic acid triesters, polyol esters, alkylbenzenes, alkylnaphthalenes, esters, polyoxyalkylene glycols, polyoxyalkylene glycol esters, polyoxyalkylene glycol ethers, polyphenyl ether, dialkyldiphenyl ethers, fluorine-containing compounds (perfluoropolyether, fluorinated polyolefins, etc.), and silicone. The polyolefins include polymers of various olefins or hydrides of these. Any polyolefin can be used, and examples include ethylene, propylene, butene, and $\alpha$-olefins with five or more carbon atoms. In the production of a polyolefin, one type of olefin or a combination of two or more types can be used.

Gas-to-liquid (GTL) oils synthesized using the Fischer-Tropsch method of converting natural gas to liquid fuel have a very low sulfur content and aromatic content as well as a very high paraffin ratio compared to mineral-oil base oils refined from crude oil. As a result, they have excellent oxidative stability and experience extremely low evaporation loss. Use of these base oils is also preferred in the present invention.

The kinematic viscosity at 100° C. (100° C. kinematic viscosity) of the base oil is preferably from 1.0 to 10 $mm^2/s$, more preferably from 1.5 to 5.0 $mm^2/s$, and even more preferably from 1.7 to 3.0 $mm^2/s$. The lubricity can be improved by using such a base oil (especially a GTL base oil).

The amount of base oil in the lubricating oil composition can be 50% by mass or more, 60% by mass or more, 70% by mass or more, 80% by mass or more, 90% by mass or more, 95% by mass or more, 97% by mass or more, or 99% by mass or more.

The coated particles are particles obtained by coating at least a portion of the surface of nanoparticles with phosphonic acid. In other words, the coated particles can also be described as nanoparticles in which phosphonic acid has been fixed to the surface.

The coated particles can be produced by bringing the nanoparticles into contact with phosphonic acid. The amount of time and temperature at which the nanoparticles and phosphonic acid are brought into contact with each other can be changed if necessary. In order to more easily fix phosphonic acid to the surface of the nanoparticles, the nanoparticles may be subjected to surface treatment beforehand.

The coated particles may be present as secondary particles (aggregates) in the composition. The average particle size taking the secondary particles among the coated particles into account can be, for example, from 5 to 1,500 nm, from 5 to 500 nm, from 20 to 200 nm, and from 50 to 100 nm. Note that the average particle size of the primary particles among the coated particles is the same as the average particle size of the nanoparticles.

The amount of coated particles in the lubricating oil composition is preferably from 0.01 to 5% by mass, more preferably from 0.02 to 3% by mass, and even more preferably from 0.05 to 0.5% by mass.

When coated particles obtained by coating the surface of nanoparticles with phosphonic acid are used, the particles become hydrophobic, and dispersibility of the particles in the base oil is improved. When these particles penetrate into a sliding surface, lubricity can be improved.

There are no particular restrictions on the material of the nanoparticles, which may be either inorganic (for example, metal, metal compounds, and carbon, etc.) or organic (for example, pigments, etc.). However, an inorganic material is preferred, and a metal oxide is especially preferred. Examples of metal oxides include nickel oxide, cobalt oxide, manganese oxide, aluminum oxide, titanium oxide, copper oxide, iron oxide, zinc oxide, and silicon oxide. Use of aluminum oxide or titanium oxide is especially preferred. One type or two or more types of nanoparticle may be used.

The average particle size of the nanoparticles is preferably from 1 to 1,000 nm, more preferably from 5 to 500 nm, even more preferably from 5 to 100 nm, and still more preferably from 10 to 100 nm. The average particle size of the nanoparticles can be measured over a measurement time of 120 seconds and at a measurement temperature of 60° C. using a measuring device utilizing the dynamic light scattering (DLS) method. (Measurement principle reference: https://unit.aist.go.jp/rima/nanoscp/coms/nano/dls.html).

The nanoparticles usually have a spherical shape, but other shapes may be used (for example, plate shaped, rod shaped, needle shaped, scale shaped, tube shaped, irregular shaped, etc.).

The amount of nanoparticles in the lubricating oil composition is preferably from 0.01 to 5% by mass, more preferably from 0.02 to 3% by mass, and even more preferably from 0.05 to 0.5% by mass.

There are no particular restrictions on the type of phosphonic acid used as long as the compound has one or more structures (preferably at least one) represented by [—P(=O)$(OH)_2$]. Examples include butyl phosphonic acid, octyl phosphonic acid, decyl phosphonic acid, dodecyl phosphonic acid, undecyl phosphonic acid, (3-carboxypropyl) phosphonic acid, 3-bromopropane phosphonic acid, (2-hydroxyethyl) phosphonic acid, (2-phenylethyl) phenethyl phosphonic acid, 10-hydroxydecyl phosphonic acid, 10-(ethoxycarbonyl) decylphosphonic acid, 2-phosphonobutan-1,2,4-tricarboxylic acid, 1-hydroxyethylidene-1,1-diphosphonic acid, aminotris (methylene phosphonic acid), and ethylenediamine tetramethylene phosphonic acid. One type of phosphonic acid or two or more types of phosphonic acids may be used.

The surface coverage of the coated particles with phosphonic acid is preferably 10% or more, more preferably 15% or more, and even more preferably 17% or more. Also, the surface coverage may be 100%, 90% or less, 80% or less, or 75% or less. The lubricity can be improved by setting the surface coverage of the coated particles in this range. The surface coverage of the coated particles can be calculated using an elemental analysis of the coated particles and the area of the surface occupied by phosphonic acid coating. Specifically, it is calculated in the following manner.

An elemental analysis of the nanoparticles coated with organic phosphonic acid is performed using an ICP-AES measurement. A Varian VISTA-MPX spectrometer manufactured by Varian Medical Systems can be used for the measurement. Before performing the elemental analysis, the sample to be measured is heated in stages at 200, 250, 300, and 350° C. for 30 minutes each in a mixed solution of ammonium sulfate, sulfuric acid, and nitric acid. After cooling, hydrochloric acid is added, the solution is heated at 150° C. for 20 minutes, and the proper volume is obtained with pure water to complete the sample solution. An example will now be described in which the nanoparticles are alumina ($Al_2O_3$) and the phosphonic acid group of the organic phosphonic acid is monovalent. The measured elements are Al (aluminum) and P (phosphorus), and Y (yttrium) is used as an internal standard. When the concentration of each is determined using the calibration curve method and the ratio x [−] of P to Al is calculated from the atomic weight of each, the ratio of modified organic phosphonic acid to alumina $Al_2O_3$ is calculated as 2× [−]. The amount of modified organic phosphonic acid per gram of alumina $Al_2O_3$ (formula amount: 101.96 [g/mol]) is calculated to be 2x/101.96 [mol]. The number of molecules of modified organic phosphonic acid is calculated to be 2NAx/101.96 [molecule] using the Avogadro constant $N_A$. Assuming that all alcohol moieties in the organic phosphonic acid react with the particle surface and are fixed at the tridentate, the area of the surface of 1 g of alumina nanoparticles occupied by the modified organic phosphonic acid is calculated to be $(2N_Ax/101.96)\times0.24$ [$nm^2$] using the area 0.24 [$nm^2$] occupied by the modified portion of the organic phosphonic acid [reference]. The surface area of 1 g of alumina nanoparticles is the specific surface area [$nm^2/g$] calculated from the gas adsorption measurement results using the BET method. BELSORP Mini II from Microtrac-BEL Corporation can be used for the measurement. Therefore, the surface coverage is calculated to be $\{(2N_Ax/101.96)\times0.24\}/A\times100$[%].

Cited Document—Alberti, G.; Casciola, M.; Costantino, U.; Vivani, R. Layered and pillared metal (IV) phosphates and phosphonates. Adv Mater 1996, 8, 291-303. DOI: 10.1002/adma.19960080405

The surface coverage of the coated particles can be adjusted by changing the contact conditions between the nanoparticles and the phosphonic acid (especially the mixing ratio of nanoparticles and phosphonic acid).

Other components that can be added include additives that are commonly added to lubricating oil compositions. Examples of these additives include dispersants, detergents, ant-wear agents, metal deactivators, antioxidants, and defoamers. One or more types of additives can be used as additional components.

The lubricating oil composition preferably contains a dispersant, and more preferably contains an amine-based dispersant. When such a dispersant is included, precipitation of coated particles can be prevented and the lubricating oil composition exhibits high lubricity. Examples of the amine-based dispersant include polyamine-based compounds such as polyolefin polyamine succinimides.

The amount of other components in the lubricating oil composition may be the balance after excluding the base oil and the coated particles and can be, for example, 30% by mass or less, 20% by mass or less, 10% by mass or less, 5% by mass or less, 3% by mass or less, or 1% by mass or less.

When the lubricating oil composition contains a dispersant, the amount of dispersant in the lubricating oil composition is preferably from 0.1 to 10% by mass, more preferably from 0.2 to 5% by mass, and even more preferably from 0.5 to 3% by mass.

The 40° C. kinematic viscosity of the lubricating oil composition is preferably from 1 to 50 $mm^2/s$, more preferably from 2 to 25 $mm^2/s$, and even more preferably from 4 to 10 $mm^2/s$. The 100° C. kinematic viscosity of the lubricating oil composition is preferably from 0.5 to 10 $mm^2/s$, more preferably from 0.8 to 8 $mm^2/s$, and even more preferably from 1 to 5 $mm^2/s$.

The density of the lubricating oil composition is preferably from 0.1 to 2.0 $g/cm^3$, more preferably from 0.5 to 1.5 $g/cm^3$, and even more preferably from 0.7 to 1.1 $g/cm^3$.

There are no particular restrictions on the method used to produce the lubricating oil composition, which can be produced by mixing together a base oil, coated particles and, if necessary, other components.

In addition to the method described above, a method that can be used to produce the lubricating oil composition includes blending the base oil, nanoparticles, and phosphonic acid together to bring the nanoparticles into contact with the phosphonic acid in the base oil, form coated particles in the base oil, and produce a lubricating oil composition.

Because it has excellent lubricity, the lubricating oil composition can be used in applications where a lubricating oil composition comes between components with sliding surfaces, and is preferably used in transmissions and internal combustion engines. Examples of transmissions include gear mechanisms, continuously variable transmissions (CVT), automatic transmissions (AT), manual transmissions (MT), and dual clutch transmissions (DCT).

EXAMPLES

The present invention will now be described in greater detail using examples and comparative examples, but the present invention is not limited to these examples.

MATERIALS

Base Oil—GTL base oil (KV 100° C.: 1.9 $mm^2/s$)

Nanoparticles—Spherical alumina particles

The average particle size (primary average particle size) is from 30 to 60 nm. The average particles sizes in the compositions are listed in the tables.

Phosphonic Acid A—Dodecylphosphonic acid (terminal alkyl group phosphonic acid)

Phosphonic Acid B—10-Hydroxydecylphosphonic acid (terminal alcohol phosphonic acid)

Phosphonic Acid C—11-Phosphono-undecylic acid (phosphonic acid terminal carboxylic acid)

Dispersant—Amine-based dispersant (OLOA 11016 from Chevron Japan, Ltd.)

Coated particles were produced by bringing the phosphonic acid and the nanoparticles into contact with each other. Table 1 shows the types of phosphonic acids used to produce the coated particles and the surface coverage of the coated particles. The surface coverage of the coated particles was adjusted by changing the mixing ratio of the nanoparticles and the phosphonic acid. Nanoparticles uncoated with phosphonic acid were used as nanoparticles D.

TABLE 1

| | | Organic Acid Coverage | | | |
|---|---|---|---|---|---|
| | | Nano-particle A | Nano-particle B | Nano-particle C | Nano-particle D |
| Particles | Alumina | ○ | ○ | ○ | ○ |
| Covering | Phosphonic Acid A | ○ | | | |
| | Phosphonic Acid B | | ○ | | |
| | Phosphonic Acid C | | | ○ | |
| Coverage | | 71% | 21% | 19% | 0% |

The components were mixed together at the blending amounts (% by mass) shown in Tables 2 and 3 to obtain lubricating oil compositions. In Comparative Example 4, nanoparticles were not included, but the same amount of phosphonic acid A as phosphonic acid A fixed to nanoparticles A was included. In Comparative Example 5, nanoparticles were not included, but an amount of phosphonic acid A that was 20 times the amount of phosphonic acid A fixed to nanoparticles A was included.

The density of the lubricating oil composition in each example was in a range from 0.7 to 1.1 $g/cm^3$. The lubricating oil composition in each example had a kinematic viscosity at 40° C. of 6.0 $mm^2/s$ and a kinematic viscosity at 100° C. of 2.0 $mm^2/s$.

The lubricity was evaluated in a friction coefficient test using a mini-traction machine (MTM) tester.

The Lubricants were testing using an evaluation method which uses a steel ball that rolls and slides on a steel disc. In the standard configuration, the ball is placed on the surface of the disc and the ball and disc are driven independently to create rolling/sliding mixed contact. The frictional force between the ball and the disc was measured using a force transducer. Additional sensors were used to measure the load, lubricant temperature, and (depending on the situation) electrical contact resistance and relative wear between the specimens.

Prior to the test, the ball and disc were dipped in a lubricant composition and heated to 60° C. Then, the coefficient of friction was measured under the following test conditions by setting the slide/roll ratio and changing the speed.

Specimen (disc): Standard steel disc from PCS Instruments (AISI52100, Ra 0.02 μm) Specimen (ball): Standard steel ball with hole from PCS Instruments (AISI52100, Ra 0.02 μm) Ball radius: 0.95 cm Warm-Up Conditions Maximum Hz pressure: 1.0 GPa Lubricant temperature: 60° C.

Entrainment speed: 1,000 mm/s

Slide/roll ratio (SRR): 0%

Testing Conditions

Maximum Hz pressure: 1.0 GPa

Lubricant temperature: 60° C.

Ball ratio: 0.95 cm

Entrainment speed: 1 to 3,000 mm/s

Slide/roll ratio (SRR): 40%

The sliding and rolling ratio (SRR) is defined as the ratio of the sliding speed ($U_{ball}$-$U_{disc}$) to the entrainment speed ($U_{ball}$+$U_{disc}$)/2.

TABLE 2

| | | Ex. 1 | Ex. 2 | Ex. 3 | C. Ex. 1 | C. Ex. 2 | C. Ex. 3 |
|---|---|---|---|---|---|---|---|
| Base Oil | Base Oil A (GS310) | Bal. | Bal. | Bal. | Bal. | Bal. | Bal. |
| Nano-particles | Nano-particle A | 0.1 | | | | 0.01 | |
| | Nano-particle B | | 0.1 | | | | |
| | Nano-particle C | | | 0.1 | | | 0.01 |
| | Nano-particle D | | | | 0.1 | | |
| Phosphonic Acid | Phosphonic Acid A | | | | | | |
| Dispersant | Dispersant Amine | 1 | 1 | 1 | 1 | 1 | 1 |
| Dispersant Particle Size (nm) | | 194 | 184 | 184 | — | 194 | 184 |
| Friction Coefficient | | 0.050 | 0.060 | 0.043 | — | 0.064 | 0.061 |
| Reduction in Friction Coefficient @ 100 mm/s (%) | | 25.4 | 10.4 | 35.7 | — | 4.5 | 9.0 |
| Evaluation | | ◎ | ○ | ◎ | X | X | X |

Evaluation Criteria
◎: Friction reduction rate at 100 mm/s ≥20%
○: Friction reduction rate at 100 mm/s <10 to 20%
X: Friction reduction rate at 100 mm/s <0 to 10%

TABLE 3

| | | Ex. 4 | Ex. 5 | Ex. 6 | C. Ex. 4 | C. Ex. 5 | C. Ex. 6 |
|---|---|---|---|---|---|---|---|
| Base Oil | Base Oil A (GS310) | Bal. | Bal. | Bal. | Bal. | Bal. | Bal. |
| Nano-particles | Nano-particle A | 0.05 | 0.15 | 0.2 | — | — | — |
| | Nano-particle B | | | | | | |
| | Nano-particle C | | | | | | |
| | Nano-particle D | | | | | | |
| Phosphonic Acid | Phosphonic Acid A | | | | Note A | Note B | |
| Dispersant | Dispersant Amine | 1 | 1 | 1 | 1 | 1 | 1 |
| Dispersant Particle Size (nm) | | 194 | 194 | 194 | — | — | — |
| Friction Coefficient | | 0.050 | 0.051 | 0.0531 | 0.064 | 0.067 | 0.067 |
| Reduction in Friction Coefficient @ 100 mm/s (%) | | 25.4 | 23.9 | 20.7 | 4.5 | 0.0 | Ref. |
| Evaluation | | ◎ | ○ | ◎ | X | X | X |

Note A-Amount fixed to Nano-particle A
Note B-Amount fixed to Nano-particle A × 20

I claim:

1. A lubricating oil composition comprising: a base oil; and in the range of from 0.05 to 0.5% by mass of coated particles made of nanoparticles and phosphonic acid coating at least a portion of the surface of the nanoparticles, wherein the surface coverage of the coated particles by phosphonic acid is 10% or more, and wherein the nanoparticles are alumina.

* * * * *